US008216020B2

(12) United States Patent
Zimet

(10) Patent No.: US 8,216,020 B2
(45) Date of Patent: Jul. 10, 2012

(54) FOLDABLE VEHICLES

(75) Inventor: Nachman Haim Zimet, Tel-Aviv (IL)

(73) Assignees: Red Blue Limited, Rosh-Ha'ayin (IL); N.Z. Nachman Zimet Ltd., Tel-Aviv (IL)

( * ) Notice: Subject to any disclaimer, the term of this patent is extended or adjusted under 35 U.S.C. 154(b) by 285 days.

(21) Appl. No.: 12/760,715

(22) Filed: Apr. 15, 2010

(65) Prior Publication Data

US 2010/0267311 A1 Oct. 21, 2010

Related U.S. Application Data

(60) Provisional application No. 61/202,873, filed on Apr. 15, 2009.

(51) Int. Cl.
*A63H 17/26* (2006.01)

(52) U.S. Cl. ..... 446/433; 446/95; 446/470; 446/487

(58) Field of Classification Search ..... 446/93, 446/94, 95, 431, 433, 440, 451, 465, 470, 446/471, 487

See application file for complete search history.

(56) References Cited

U.S. PATENT DOCUMENTS

| | | | |
|---|---|---|---|
| 2,018,527 | A | 10/1935 | Kerr |
| 2,182,913 | A | 12/1939 | Brubaker |
| 2,360,220 | A | 10/1944 | Goldman |
| 2,436,643 | A | 2/1948 | Hatner |
| 2,616,214 | A | 11/1952 | Hydrick |
| 2,778,158 | A | 1/1957 | Ernst |
| 2,832,426 | A | 4/1958 | Seargeant |
| 3,859,752 | A | 1/1975 | Morrison et al. |
| 4,192,093 | A | 3/1980 | Hamano et al. |
| 4,248,006 | A | 2/1981 | Jones et al. |
| 4,391,060 | A | 7/1983 | Nakane |
| 4,418,495 | A | 12/1983 | Kennedy et al. |
| 4,433,504 | A | 2/1984 | Terui et al. |

(Continued)

FOREIGN PATENT DOCUMENTS

| | | | |
|---|---|---|---|
| EP | 496031 | A1 | 7/1992 |

(Continued)

OTHER PUBLICATIONS

GB Search Report issued on Jul. 14, 2010 in GB Application No. 1006117.4.

(Continued)

*Primary Examiner* — Nini Legesse
(74) *Attorney, Agent, or Firm* — Panitch Schwarze Belisario & Nadel LLP

(57) ABSTRACT

A vehicle reconfigurable between an unfolded configuration and a folded configuration includes a body having opposing upper and lower parts extending between lateral sides and ends of the body. A first wheel and a second wheel are each operatively mounted to the body to at least partially support the body for movement. A first suspension assembly and a second suspension assembly pivotally connect each wheel to the body and a linkage assembly connects the body to each wheel. The linkage assembly is adapted to pivot each wheel with respect to the body. A linear compression bias member is mounted between the upper and lower parts of the body to bias the upper part of the body away from the lower part of the body. The vehicle transforms from the unfolded configuration to the folded configuration by compression of the upper part and lower part together to actuate the linkage and compress the linear compression bias member.

15 Claims, 7 Drawing Sheets

U.S. PATENT DOCUMENTS 4,458,444 A 7/1984 Avery et al.
4,473,969 A 10/1984 Wilson
4,516,948 A 5/1985 Obara
4,522,606 A 6/1985 Goldfarb et al.
4,529,389 A 7/1985 Kennedy et al.
4,571,203 A 2/1986 Murakami
4,578,046 A 3/1986 Ohno
4,580,993 A 4/1986 Ohno
4,586,911 A 5/1986 Murakami
4,626,223 A 12/1986 Sweet
4,668,205 A 5/1987 Choy et al.
4,674,990 A * 6/1987 Ohno ..... 446/376
4,680,018 A 7/1987 Ohno
4,690,654 A 9/1987 DeLaney
4,718,875 A 1/1988 McKittrick et al.
4,750,895 A 6/1988 Shinohara et al.
5,135,427 A 8/1992 Suto et al.
5,228,880 A 7/1993 Meyer et al.
5,334,075 A 8/1994 Kakizaki et al.
5,334,076 A 8/1994 Shinozuka
5,364,300 A 11/1994 Jow
5,372,534 A 12/1994 Levy et al.
5,494,304 A 2/1996 Levy et al.
5,643,041 A 7/1997 Mukaida
5,871,386 A 2/1999 Bart et al.
5,921,843 A 7/1999 Skrivan et al.
6,036,574 A 3/2000 Halford
6,066,026 A 5/2000 Bart et al.
6,132,287 A 10/2000 Kuralt et al.
6,322,088 B1 11/2001 Klamer et al.
6,350,171 B1 * 2/2002 Hippely et al. ..... 446/440
6,394,876 B1 5/2002 Ishimoto
6,468,128 B1 10/2002 Bala et al.
6,540,583 B1 4/2003 Hoeting et al.
6,692,333 B2 2/2004 Kislevitz et al.
6,752,684 B1 * 6/2004 Lee ..... 446/456
6,910,939 B2 6/2005 Hui
6,913,507 B2 7/2005 Hui
6,926,581 B2 8/2005 Lynders et al.
6,957,996 B2 10/2005 Hui
6,970,096 B2 11/2005 Nagata et al.
7,033,241 B2 4/2006 Lee et al.
7,101,250 B2 9/2006 Lam et al.
7,184,364 B2 2/2007 Sawin et al.
7,217,170 B2 5/2007 Moll et al.
7,234,992 B2 6/2007 Weiss et al.
7,288,917 B2 10/2007 Art et al.
7,387,558 B2 6/2008 Swisher et al.
7,393,260 B2 7/2008 Yamaguchi
7,410,404 B2 8/2008 Saeki
7,466,624 B2 12/2008 Sawin et al.
7,503,828 B2 3/2009 Lee
7,563,150 B2 7/2009 Yamaguchi et al.
7,568,965 B2 8/2009 Toriyama et al.
7,722,426 B2 * 5/2010 Campbell ..... 446/4
2002/0132556 A1 9/2002 So
2002/0182974 A1 12/2002 Grabianski
2003/0104756 A1 6/2003 Gordon
2003/0224694 A1 12/2003 Hoeting et al.
2006/0135035 A1 6/2006 Leung
2006/0270313 A1 11/2006 Campbell
2006/0270314 A1 11/2006 Campbell et al.
2006/0270321 A1 11/2006 Benedict
2007/0173173 A1 7/2007 Suzuki
2008/0171486 A1 7/2008 Nagaoka
2008/0207079 A1 8/2008 Corsiglia et al.
2009/0124164 A1 5/2009 Willett

FOREIGN PATENT DOCUMENTS

EP 1226855 A2 7/2002
FR 2549382 A1 1/1985
JP 05245270 A 9/1993
JP 2003334390 A 11/2003
JP 2006314440 A 11/2006
WO WO-2010004459 A1 1/2010

OTHER PUBLICATIONS

Five Images of "FLAT RYDERZ" Play sets and Toy Vehicles, Geospace International, Seattle, Washington, Circa 2006, (1 page in color).

* cited by examiner

FOLDABLE VEHICLES

CROSS-REFERENCE TO RELATED APPLICATIONS

The present application claims priority to U.S. Provisional Patent Application No. 61/202,873, filed Apr. 15, 2009 and entitled "POP UP APPARATUS," the entire subject matter of which is hereby incorporated herein by reference.

BACKGROUND OF THE INVENTION

The present invention relates generally to foldable vehicles and, more particularly, to vehicles that are selectively reconfigurable between a generally or substantially flat or "folded" configuration for storage or transportation purposes, for example, and an erect or "open" or "unfolded" configuration for movement on or across a ground surface or other operation.

Conventional toy vehicles (i.e., cars, trucks, sport utility vehicles) are well known. Conventional toy vehicles can be rather large and have a generally irregular shape. The size and shape of conventional toy vehicles results in relatively large packaging or inefficient use of space during travel or transportation of these vehicles by a user, distributor or manufacturer. Relatively small conventional toy vehicles, such as those sold under the name Micro Machines® by Hasbro®, do not necessarily require relatively large packaging. However, these smaller toy vehicles can still occupy an unnecessary amount of space due to their generally irregular or eccentric shape, especially when kept as part of a collection of such vehicles.

One prior art toy vehicle that attempts to overcome the above-identified deficiencies is disclosed in U.S. Pat. No. 6,468,128 (Bala). Specifically, Bala discloses a collapsible toy car 10 having a front top portion 12 pivotally attached to a rear top portion 14 by a hinge 20. Remote ends of the front top portion 12 and the rear top portion 14 define opposing front and rear ends of the toy car 10. Two "side portions" 16, 18 are each pivotally hinged to the front and rear top portions 12, 14 along a separate lateral side of the front top portion 12 and rear top portion 14, so as to pivot about an axis that extends generally parallel to and along one of the lateral sides between the ends. The two side portions 16, 18 define opposing right and left lateral sides of a "body" of the toy car 10 that extend between the front and rear ends. Two wheels 22 are attached to each side portion 16. Attachment means 30, which includes two spaced-apart torsion springs 72, exert rotational forces 32 (FIG. 3) on an interior surface of each side portion 16, 18 or on inside and outside panels 60, 66 (i.e., a planar frame) that form part of the side portions 16, 18. Thus, the side portions 16, 18 are pivotably in a range of approximately ninety degrees between a first position (FIG. 2*b*) in which the side portions 16, 18 extend in plane generally parallel to a central horizontal longitudinal plane defined by the top portions 12, 14, and a second position (FIG. 3) in which the side portions 16, 18 extend in a plane generally perpendicular to the central horizontal longitudinal plane defined by the top portions 12, 14.

Specifically, the two torsion springs 72 exert a continuous rotational force on a portion of each side portion 16, 18 tending to position the side portions 16, 18 in a vertical or operational configuration (FIG. 1). When a force is applied to the top portion 12, 14 of the car 10, the side portions 16, 18 rotate outwardly against the rotational force exerted by the two torsion springs 72. In this configuration, the toy vehicle 20 is collapsed and may be inserted into a storage case 30 for transporting or storing the toy car 10 (FIGS. 2 and 5). Once the above-identified force is removed, the rotational force exerted by the torsion springs 72 returns the side portions 16, 18 to their erect, operational configuration (FIGS. 1 and 6). The Bala toy car 10 is not self-propelled or drivable by a remote controller. Further, the Bala toy car 10 includes an exterior frame (top portion 12, 14 and side portions 16, 18) having a plurality of parts that are all movably attached. As a result, the Bala toy car 10 can be awkward to collapse and configure to return to the operational configuration.

Therefore, it would be desirable to create a vehicle that overcomes the above-identified deficiencies. Specifically, it would be desirable to create a toy vehicle that is easily selectively reconfigurable between a "folded" or generally, preferably essentially flat configuration for storage and transportation purposes, for example, and an "unfolded" or "open" or erect configuration for operation. Further, it would be desirable to create such a reconfigurable toy vehicle that includes a propulsion system that allows a user to propel and maneuver the toy vehicle.

BRIEF SUMMARY OF THE INVENTION

Briefly stated, one aspect of the present invention is directed to a vehicle reconfigurable between an unfolded configuration and a folded configuration that includes a body having opposing left and right lateral sides, opposing front and rear ends, and opposing upper and lower parts extending between the lateral sides and the ends. A first wheel and a second wheel are each operatively mounted to the body to at least partially support the body for movement. A first suspension assembly and a second suspension assembly pivotally connect each of the first wheel and the second wheels to the body. A linkage assembly connects the body to each of the first and second wheels. The linkage assembly is adapted to pivot each wheel with respect to the body. At least one linear compression bias member is mounted between the upper and lower parts of the body to bias the upper part of the body away from the lower part of the body. The vehicle transforms from the unfolded configuration to the folded configuration by compression of the upper part and lower part together to actuate the linkage and compress the linear compression bias member.

In another aspect, the present invention is directed to vehicles that include a body having opposing right and left lateral sides, opposing front and rear ends, and opposing upper and lower parts extending between the lateral sides and the ends. A driving wheel is operatively mounted to the body to at least partially support the body and propel the body on or across a ground surface. The driving wheel is rotatably mounted to a frame that supports a motor, a worm, and a gear train. A suspension assembly pivotally connects the frame to the body. Operation of the motor rotates the worm, which in turn drives the gear train, which in turn rotates the driving wheel to propel the vehicle.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown. In the drawings.

DETAILED DESCRIPTION OF THE INVENTION

Figure 1A:
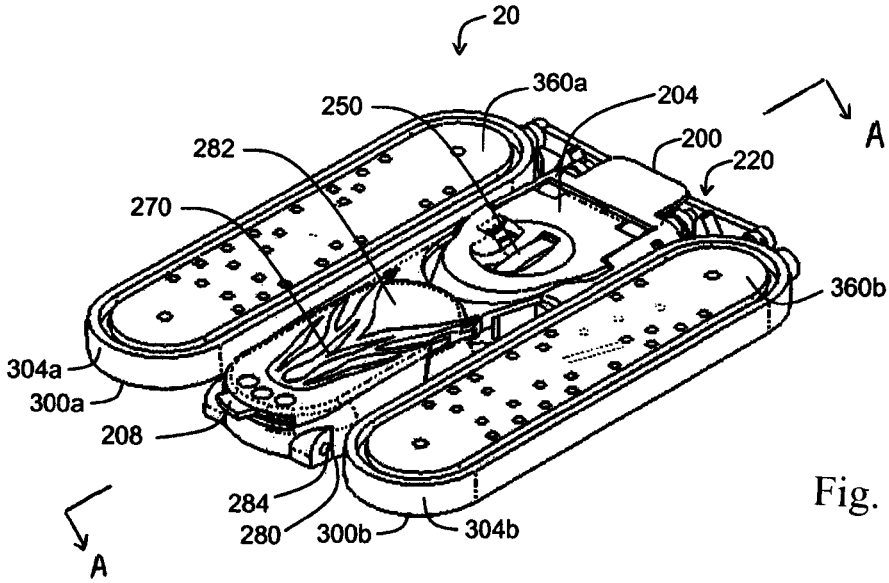
FIG. 1A is a top left perspective view of a toy vehicle in a folded configuration in accordance with a preferred embodiment of the present invention.

Certain terminology is used in the following description for convenience only and is not limiting. The words "right," "left," "upper," and "lower" designate directions in the drawings to which reference is made. The words "first" and "second" designate an order or operations in the drawings to which reference is made, but do not limit these steps to the exact order described. The words "inner," "outer," "inwardly" and "outwardly" refer to directions toward and away from, respectively, the geometric center of the toy vehicle and designated parts thereof. Additionally, the terms "a," "an" and "the," as used in the specification, mean "at least one." The terminology includes the words above specifically mentioned, derivatives thereof, and words of similar import.

Referring to the drawings in detail, wherein like numerals indicate like elements throughout, there is shown in FIGS. 1A-5C a preferred embodiment of a vehicle, generally designated 20, in accordance with the present invention and components thereof. Although reference is made specifically to toy vehicle 20 having "wheels" or "tracks," it is understood by those skilled in the art that the specific structural arrangements and methods described herein may be employed in virtually any type of toy vehicle, such as automobiles, bicycles, motorcycles, scooters, etc., having any number of wheels, tracks, etc. and further that the invention may be scaled up into larger vehicles. Thus, the toy vehicle 20 is not limited to the design shown and described herein, be may be formed in any one of or combination of multiple shapes, designs and colors such as cars, boats, motorcycles, bicycles, trucks, tractors, military-like vehicles, such as tanks, aircraft and airborne vehicles, submarines, marine vehicles, as well as space vehicles, robots, creatures, animals and other kinds of toys.

In the following description, various aspects of a "pop-up" apparatus will be described. For the purpose of explanation, specific configurations and details are set forth in order to provide a thorough understanding of the apparatus. In accordance with the following description, a toy vehicle 20, which is one embodiment of the apparatus of the present invention, is described in detail. However, it will also be apparent to one skilled in the art that the toy may be described without specific details being presented herein. Furthermore, well-known features may be omitted or simplified in order not to obscure the description(s) of the techniques.

Although various features of the disclosure may be described in the context of a single embodiment, the features may also be provided separately or in any suitable combination. Conversely, although the disclosure may be described herein in the context of separate embodiments for clarity, the disclosure may also be implemented in a single embodiment. Furthermore, it should be understood that the disclosure can be carried out or practiced in various ways, and that the disclosure can be implemented in embodiments other than the exemplary ones described herein below. The descriptions, examples and materials presented in the description, as well as in the claims, should not be construed as limiting, but rather as illustrative.

Figure 4A:
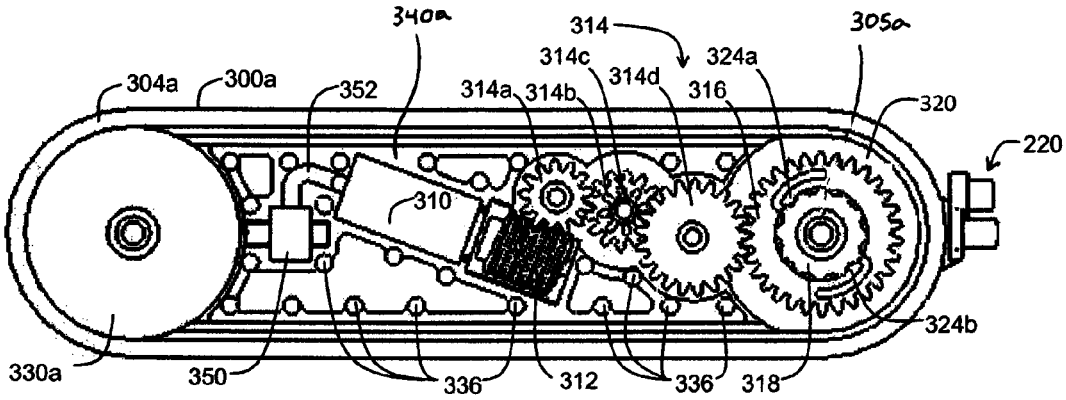
FIG. 4A is a schematic elevation view of a portion of a driving system of the toy vehicle shown in FIG. 1A.
Figure 4B:
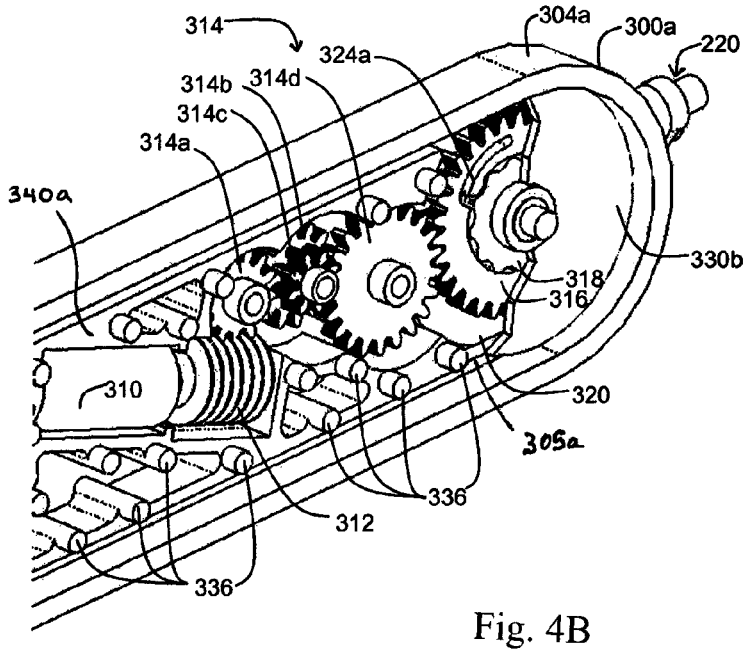
FIG. 4B is a schematic perspective view of a portion of the driving system shown in FIG. 4A.
Figure 4C:
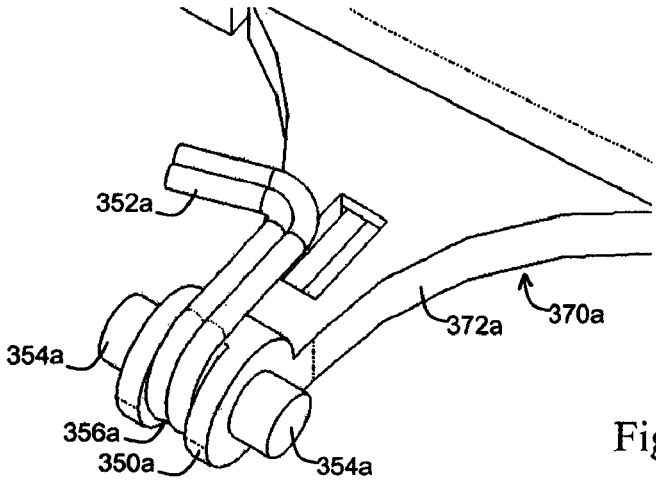
FIG. 4C is an enlarged perspective view of a suspension assembly of the toy vehicle shown in FIG. 1A.
Figure 4D:
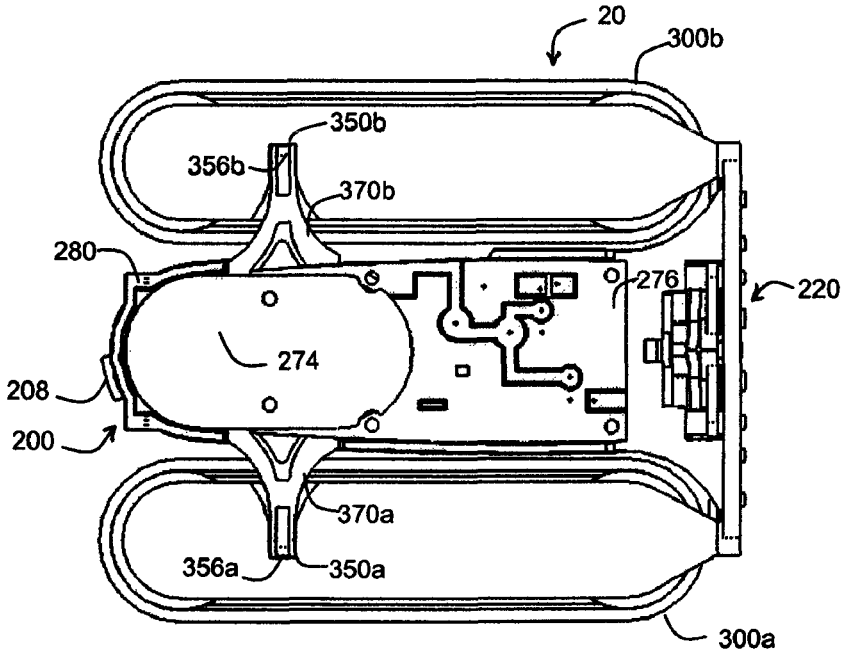
FIG. 4D is a bottom plan view of the toy vehicle shown in FIG. 1A in the folded configuration.

In accordance with the preferred embodiment of the present invention, the toy vehicle 20 preferably includes a body or chassis 200, a folding/unfolding assembly or linkage 220, a locking system 252, 254, and at least one and preferably two, minor image suspension assemblies 370*a*, 370*b*. The body 200 may include a canopy 204. The toy vehicle 20 includes at least one and preferably two minor image driving systems 300*a*, 300*b*, at least one and preferably two identical motors 310, a power supply unit 272*a*, 272*b* and a control assembly 276 (FIG. 4D). In the preferred embodiment, the power supply unit is one or more batteries 272*a*, 272*b* (disposable or rechargeable) or one or more capacitors. The toy vehicle 20 may further include a canopy ascending system, that allows the canopy 204 in an unfolded configuration (FIGS. 1B and 2C) to raise up above the body 200.

In the preferred embodiment, the toy vehicle 20 is in a substantially flat or "folded" configuration (FIGS. 1A, 2A, 3A) while not being played with. The erect or "unfolded" or "open" toy vehicle 20 preferably has good maneuverability and may move in one or more of a variety of directions, including without limitation, forward, backward, turns to the right, turns to the left, turn around, and climb and cross obstacles.

In accordance with embodiments of the present invention, conversion of the toy vehicle 20 from the generally flat or folded configuration to the erect or unfolded or open (i.e., three-dimensional) configuration is conducted by a "pop-up mechanism." The term "pop-up mechanism" as used herein describes a sudden appearance, a sudden rise up from the generally flat or folded configuration to the three-dimensional erect or unfolded configuration. The pop-up mechanism of the present invention is adapted to convert the apparatus configuration via an energy storing element, preferably a spring, a capacitor or a battery (disposable or rechargeable). The term "action" as used herein includes without limitation any activity, movement and effect, manual or automatic that results in a conversion of configuration of the toy vehicle 20 from the generally flat or folded configuration to the three-dimensional erect or unfolded configuration. In the preferred embodiment, the "action" activates at least one of the folding/unfolding assembly 200 and locking system 252, 254, and functionally allows unfolding of the body 200, driving system 300*a*, 300*b* and the canopy ascending system.

Figure 5A:
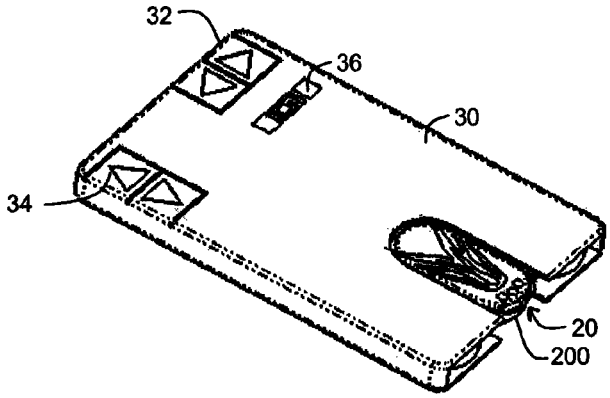
FIG. 5A is a top perspective view of the toy vehicle shown in FIG. 1 in the folded configuration inside a shell in accordance with a preferred embodiment of the present invention.
Figure 5B:
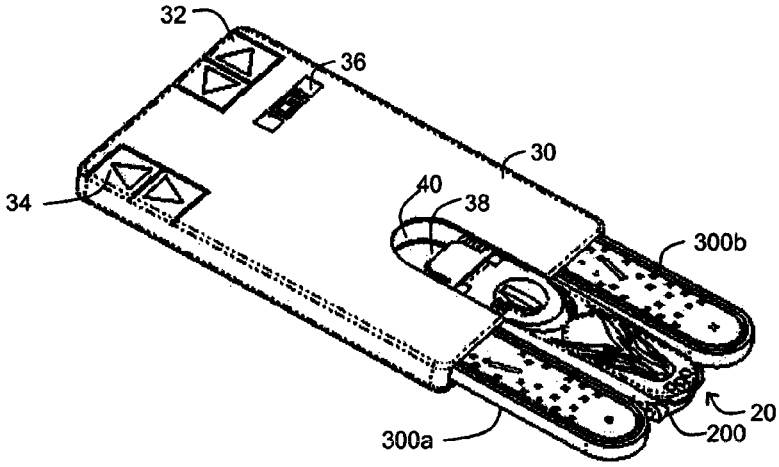
FIG. 5B is a top perspective view of the toy vehicle and shell shown in FIG. 5A, wherein the toy vehicle is partially removed from the shell.
Figure 5C:
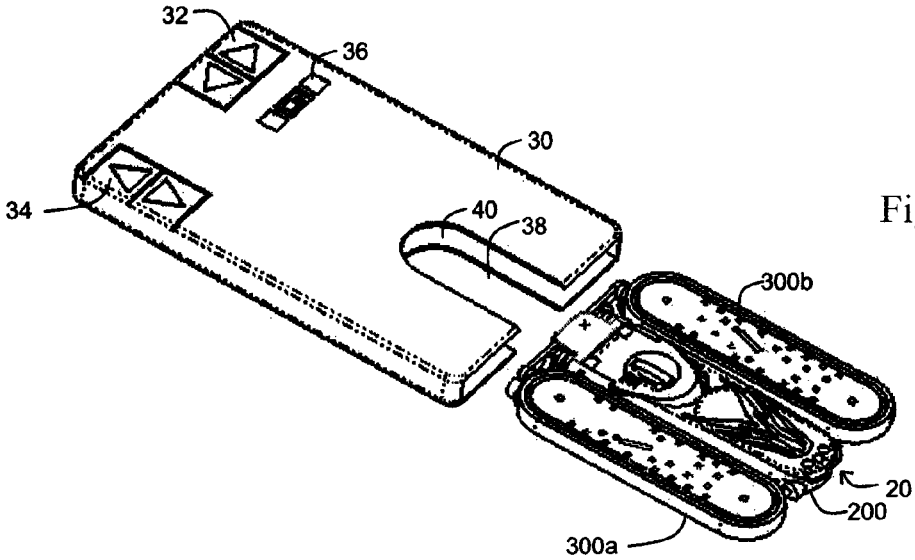
FIG. 5C is a top perspective view of the toy vehicle and shell shown in FIG. 5A, wherein the toy vehicle is completely removed from the shell.

As seen in FIGS. 5A-5C, the toy vehicle 20 may also be stored within a shell 30. Thus, the shell 30 may function as a storage element. Additionally or alternatively, the shell 30 may function as a remote control to thereby operate the toy vehicle 20 in the unfolded or three-dimensional erect configuration. In such an embodiment, the shell 30 may function as a wireless remote control of the pop-up toy vehicle 20.

In the preferred embodiment, the toy vehicle 20 in the folded or flat configuration has a card-like size and shape with a thickness suggestively in a range of three to fifteen millimeters, such that the toy vehicle 20 can be carried in a pants pocket, for example. The toy vehicle 20 can be made of various materials such as plastic, metal and any other rigid material suitable for the purpose of the present invention. Alternatively, in the folded or flat configuration the toy vehicle 20 may have a larger dimensions ratio of thickness to length, or width. For example, such ratio may be in the range of four to ten.

The toy vehicle 20 preferably includes several assemblies, systems and features that functionally allow the conversion of the toy vehicle 20 by one or a single unfolding or pressing action. For example, the folding/unfolding assembly 220 may be adapted to allow opening and closing of the at least one driving system 300*a*, 300*b*. The locking system 252, 254 may be adapted to maintain the generally flat orientation of the toy vehicle 20, and further to allow unfolding of the toy vehicle by the pop-up mechanism when released. The suspension assembly 370*a*, 370*b* may be adapted to allow routing of electrical wires 352 and connection of the body 200 with the at least one driving system 300*a*, 300*b*. The canopy ascending system may be adapted to allow vertical movement of the canopy 204 above the body 200.

The toy vehicle 20 is further preferably adapted to convert from the three-dimensional erect configuration to the generally flat configuration by squeezing at least a portion of the toy vehicle 20 and, more particularly, by squeezing together an upper chassis or upper part 282 of the body 200 and a lower chassis or lower part 280 of the body 200 or, in other words, compression together of the upper part 282 and the lower part 280. The toy vehicle 20 may also be adapted to convert from the three-dimensional erect configuration to the generally flat configuration by a single action, such by one press of a button. Alternatively, the conversion from the three-dimensional erect configuration to the generally flat configuration may be conducted by squeezing of at least a portion of the toy vehicle 20.

As both sides of the toy vehicle 20 are mirrored parts, similar parts are designated with the same number and followed by either an "a" or "b". For clarity reasons, the description will focus on one side at a time, although the opening of vehicle toy 20 is conducted simultaneously at both sides.

Each driving system 300*a*, 300*b* is preferably generally flat. In the preferred embodiment, each driving system 300*a*, 300*b* includes the at least one electrical motor 310, a worm 312 and a gear train 314 that functionally are capable of moving a driving wheel 320, sometimes referred to simply as "wheel 320" The driving wheel 320 may further comprise a clutch 324*a*, 324*b* for preventing damage when external force is applied on or to the driving wheel 320.

Figure 1B:
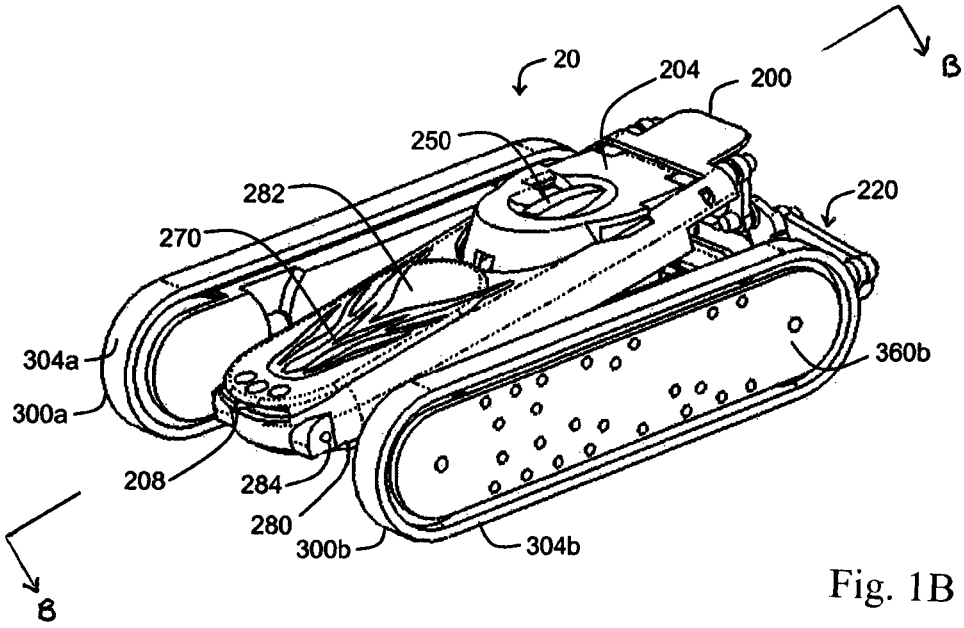
FIG. 1B is a top left perspective view of the toy vehicle shown in FIG. 1A in a fully open, unfolded, three-dimensional configuration.

Referring to FIGS. 1A and 1B, the toy vehicle 20 preferably includes the body 200 and the two symmetrically identical driving systems 300*a*, 300*b*, wherein each driving system includes a track 304*a*, 304*b*, respectively, located on right and left sides of body 200. As best seen in FIGS. 4C-4D, the toy vehicle 20 preferably includes the suspension assemblies 370*a*, 370*b* each adapted for pivotally connecting each driving system 300*a*, 300*b* to the body 200 and for routing the electrical wires 352 (FIGS. 4C and 4D) from the body 200 to the electrical motor 310 (FIGS. 4A and 4B) of each of the driving systems 300*a*, 300*b*. The body 200 preferably includes the upper part or upper chassis 282, the lower part or lower chassis 280, a front hinge 284 (FIGS. 1A, 1B and 3D) adapted for pivotally connecting the upper and lower chassis 282, 280 such that the upper chassis 282 can be "opened" and "closed" (raised and lowered), the canopy 204, the opening button 250, a battery compartment 270 (FIGS. 3A and 3C), an "ON/OFF" switch 208 (FIGS. 1A, 1B, 3D and 4D), and an electronic control assembly, part of which is indicated at 276 (FIG. 4D). The "ON/OFF" switch 208 may be a sliding switch, a pushing switch, or any other type of switch that is suitable with the present invention. As seen in FIGS. 1A and 1B, each driving system 300*a*, 300*b* preferably includes a cover 360*a*, 360*b*. The toy vehicle 20 further preferably includes the folding/unfolding assembly or linkage 220 described in detail below.

Figure 2A:
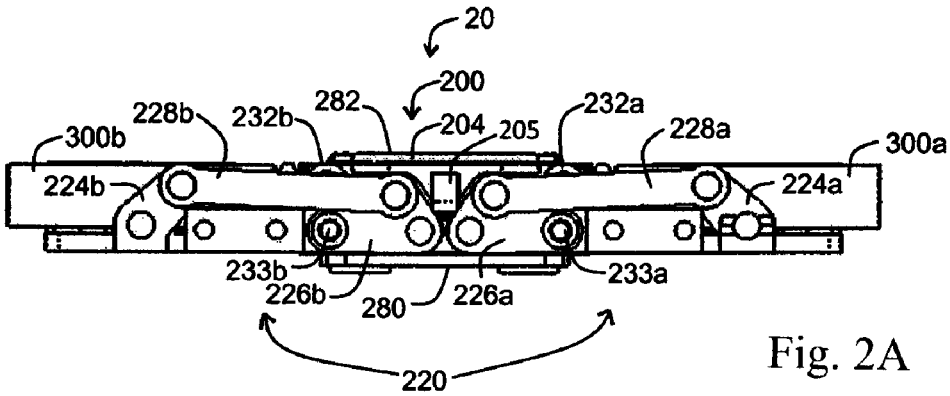
FIG. 2A is a rear elevation view of the toy vehicle shown in FIG. 1A in the folded configuration.
Figure 2B:
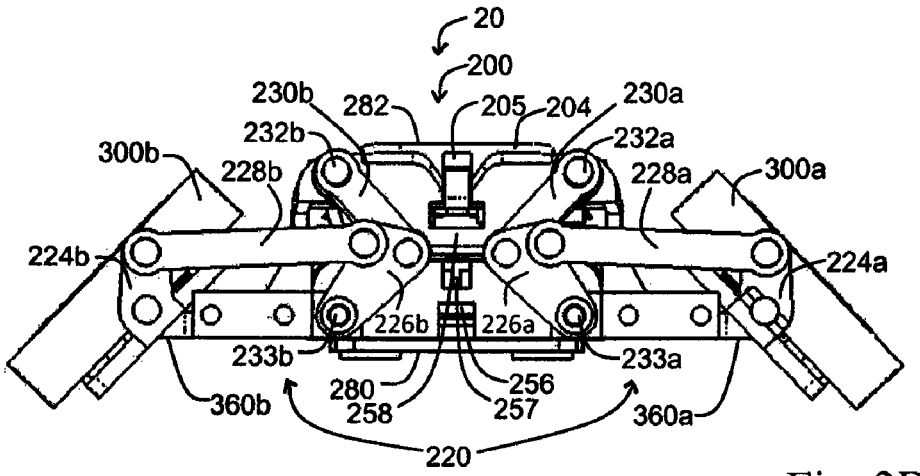
FIG. 2B is a rear elevation view of the toy vehicle shown in FIG. 1A in a partially unfolded configuration.
Figure 2C:
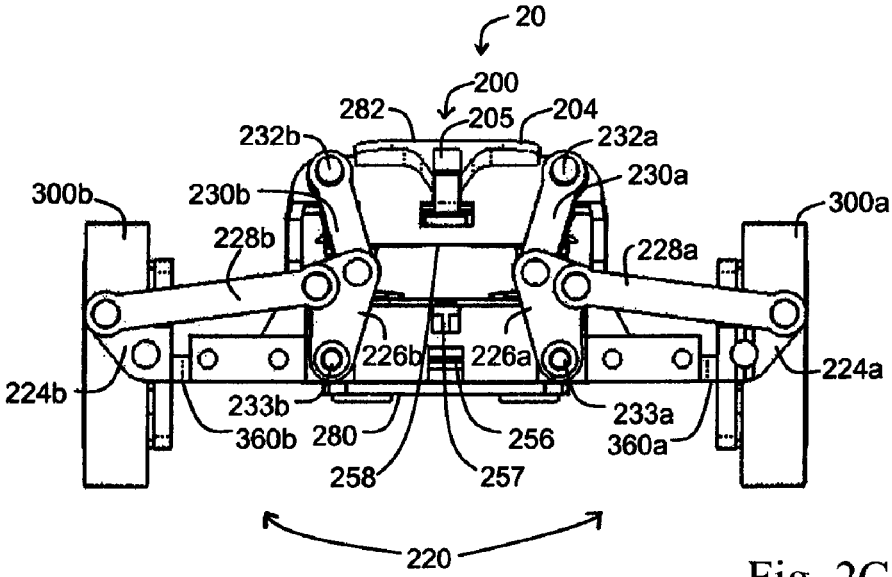
FIG. 2C is a rear elevation view of the toy vehicle shown in FIG. 1A in the fully open, unfolded, three-dimensional configuration.

Referring now to FIGS. 2A-2C, the folding/unfolding assembly or linkage 220 is adapted to allow opening and closing of at least one and preferably both of the driving systems 300*a*, 300*b*. Preferably, the folding/unfolding assembly 220 allows the opening of each driving system 300*a* and 300*b* when a user presses the opening button 250 (FIGS. 3A-3C and 3H). Opening or unfolding of the toy vehicle 20 from the generally flat or folded configuration to the three-dimensional erect or unfolded configuration is conducted by pressing downwardly on the opening button 250 to move and thereby release a sliding lock 252 (FIGS. 3A-3C and 3F-3H). Consequently, the upper part 282 of the body 200 ascends (goes up) and preferably pulls upper link 230*a* upwardly as it is connected to the upper part 282 of the body 200 by axle 232*a*. Upper link 230*a*, when pulled up, preferably turns or rotates a turn crank 226*a* aside, and thus, the turn crank 226*a* preferably pushes a side link 228*a* in a lateral direction (i.e., outwardly, away from a geometric center of the body 200). Consequently, the side link 228*a* preferably pushes driving system 300*a* outwardly via a driving crank 224*a*.

The same process is conducted simultaneously in mirror image on the other side of the toy vehicle 20. Specifically, the upper part 282 of the body 200 ascends (goes up) and pulls an upper link 230*b* up as it is connected to the upper part 282 of the body 200 by an axle 232*b*. The upper link 230*b*, when pulled up, preferably turns a turn crank 226*b* aside, and thus, the turn crank 226*b* preferably pushes a side link 228*b* in a lateral direction (i.e., outwardly, away from a geometric center of the body 200). Consequently, the side link 228*b* preferably pushes the driving system 300*b* outwardly via a driving crank 224*b*. As seen in FIGS. 2A-2C, axles 233*a*, 233*b* preferably rotatably attach each turn crank 226*a*, 226*b*, respectively, to the lower part 280 of the body 200.

Figure 3A:
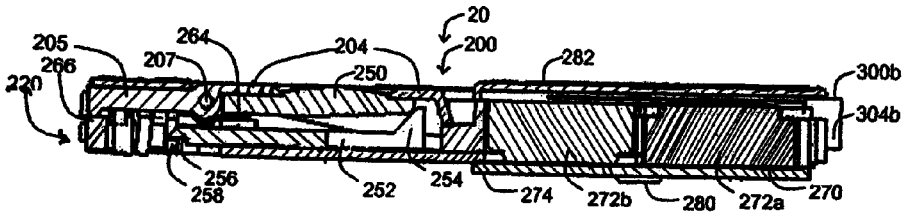
FIG. 3A is a cross-sectional elevation view of the toy vehicle shown in FIG. 1A, taken along line A-A of FIG. 1A.
Figure 3B:
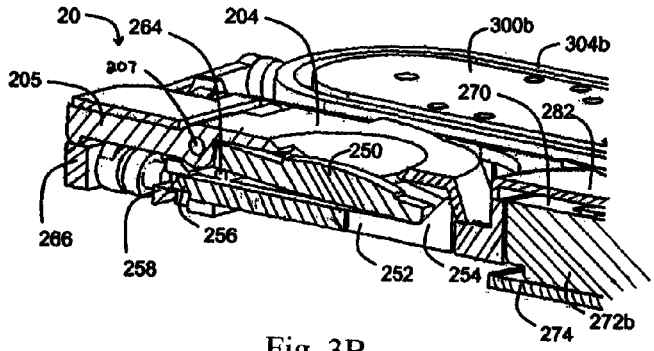
FIG. 3B is a cross-sectional perspective view of a portion of the toy vehicle shown in FIG. 1A, taken along line A-A of FIG. 1A, wherein a button of the toy vehicle is shown in a depressed position.

A latch holder 258, which is part of the upper chassis 282 of the body 200, and a sliding latch 256 (both seen in FIGS. 2B-3C) functionally hold and prevent the upper chassis 282 from being opened while the toy vehicle 20 is in the generally flat or folded configuration (FIGS. 2A, 3A and 3B). At least one and preferably a pair of opposing, resiliently flexible extensions 267*a*, 267*b* extend outwardly or laterally from the sliding latch 256. Each extension 267*a*, 267*b* is preferably sized and shaped to fit within a complimentary sized and shaped slot or groove 259 (FIG. 3G) in the lower chassis 280 of the body 200. As shown in FIGS. 3F and 3G, the sliding latch 256 is preferably integrally and unitarily formed with the sliding lock 252 and an angled slide edge 254 thereof. However, the sliding latch 256 and the sliding lock 252, with its angled slide edge 254, may be two or more separate structures fixedly or removably attached. Thus, each extension 267*a*, 267*b* preferably biases both the sliding latch 256 and the sliding lock 252 in an initial or stationary position within the body 200 (FIGS. 3A, C and G). A slot 257 for receiving a canopy tail 205, while the toy vehicle 20 is in the generally flat or folded configuration, is also shown in FIGS. 2B, 2C. Folding the toy vehicle 20 back into the generally flat configuration is preferably conducted by compression (i.e., squeezing together) the top chassis 282 and the lower chassis 280 along or in a vertical direction (not shown) to actuate the linkage 220 and compress a linear compression bias member, such as compression coil spring 260, as described in detail below. A "linear compression bias member" is defined herein as a bias member which compresses (and recovers) in an at least a generally linear direction.

Figure 3C:
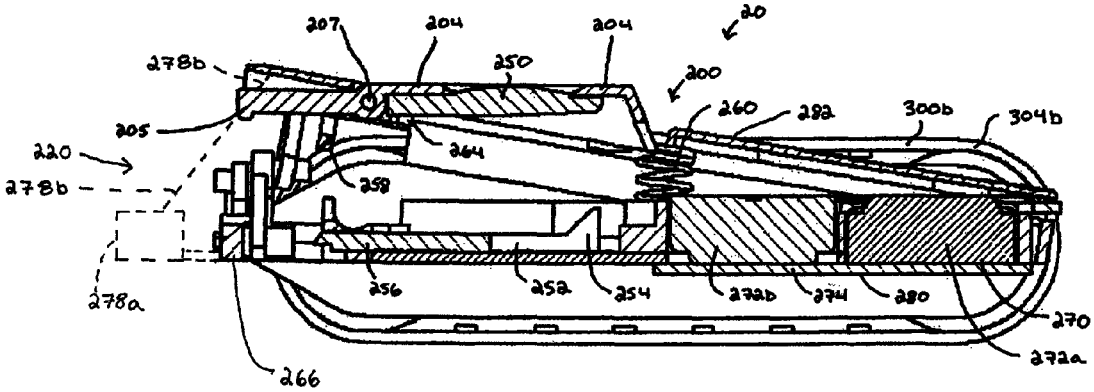
FIG. 3C is a cross-sectional elevation view of the toy vehicle shown in FIG. 1B, taken along line B-B of FIG. 1B.
Figure 3D:
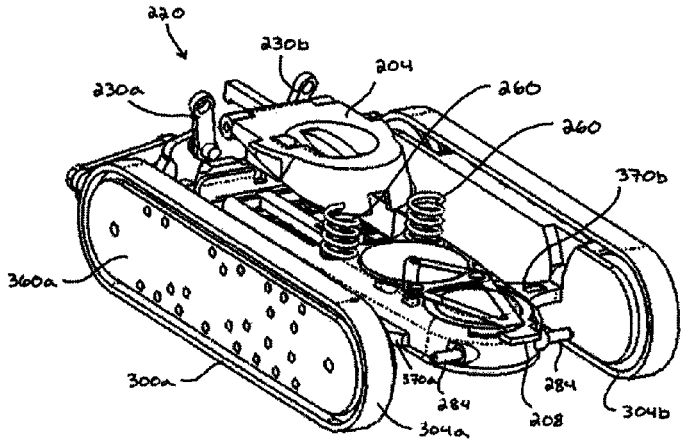
FIG. 3D is a perspective view of the toy vehicle shown in FIG. 1B, with an upper part of the toy vehicle removed for clarity.
Figure 3E:
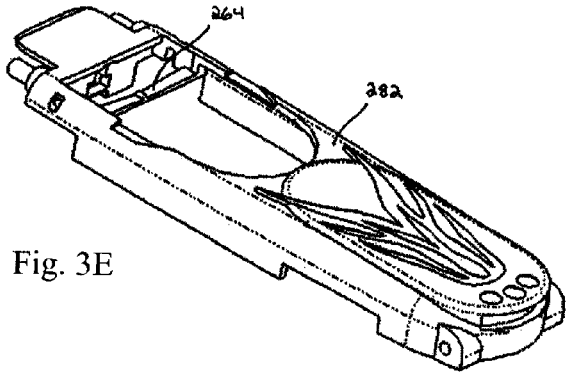
FIG. 3E is a perspective view of the upper, front and right side of the removed upper part of the toy vehicle shown in FIG. 1B.
Figure 3F:
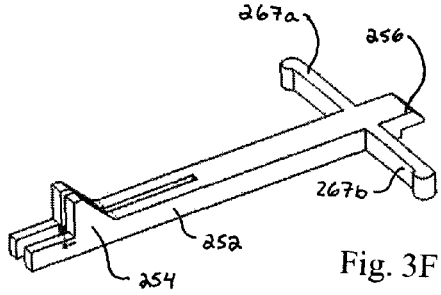
FIG. 3F is a perspective view of the upper, front and left side of a removed locking system and sliding latch of the toy vehicle shown in FIG. 1B.
Figure 3G:
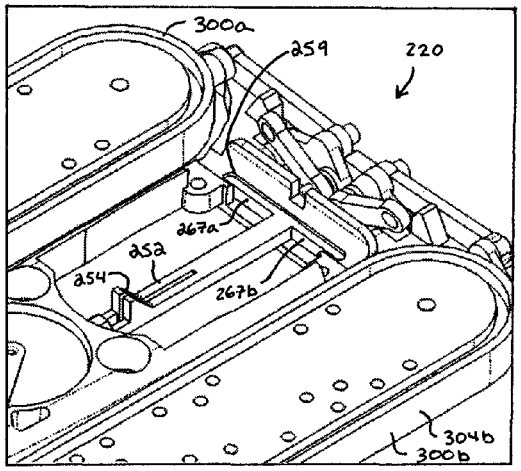
FIG. 3G is a perspective view of a portion of the upper, front and left side of the toy vehicle, with at least the upper part and the button removed for clarity.
Figure 3H:
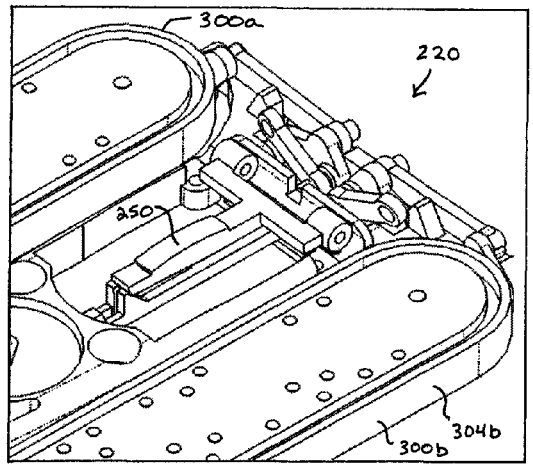
FIG. 3H is a perspective view of a portion of the upper, front and left side of the toy vehicle, with at least the upper part removed for clarity.

More particularly, upon squeezing the canopy 204 downwardly, the canopy tail 205 preferably makes contact with a pushback bar 266 (FIGS. 3A-3C), which in response pushes the canopy tail 205 upwardly, and the canopy tail 205 pushes the canopy 204 downwardly around a canopy axis 207 (FIGS. 3A-3C). When the canopy 204 is pushed downwardly it preferably pushes the opening button 250 downwardly against a resiliently flexible "springy" beam 264 (FIGS. 3A-3C and 3E) to thereby fold the toy vehicle 20 back into the generally flat configuration. In this folded configuration, the sliding latch 256 preferably engages or locks the latch holder 258 and the toy vehicle 20 is locked in the folded configuration.

Opening or unfolding of the toy vehicle 20, or conversion of the toy vehicle 20 from the generally flat or folded structure to the three-dimensional erect structure, is preferably conducted simultaneously by multiple parts of the toy vehicle 20. Specifically, upon release of the sliding latch 256, or removal of engagement between the latch holder 258 and the sliding latch 256, or equivalent removal of the downwardly-applied force holding the toy vehicle 20 in the folded configuration, the upper chassis 282 is preferably pushed upwardly by at least one and preferably two spaced-apart compression coil springs 260 (FIGS. 3C and 3D), which in turn pulls or unfolds the linkage 220 which pivots or unfolds the driving systems 300*a*, 300*b*. At the same time, it is preferred that the pressure on the canopy tail 205 is released to thereby allow the canopy 204 to unfold as well. In other words, upon or after pressing the opening button 250, the upper part 282 of the body 200 is preferably opened or raised by the pop-up mechanism illustrated in FIGS. 3A-3C. Simultaneously, the linkage 220 shown in FIGS. 2A-2C is activated by the upward movement up of the upper part 282 of the body 200 and thereby opens the driving systems 300*a*, 300*b* resulting in the unfolded or three-dimensional erect toy vehicle 20.

More specifically, in accordance with the preferred embodiment of the present invention, the opening of the toy vehicle 20 occurs by pressing the opening button 250, preferably downwardly, that affects the sliding lock 252 in a manner that its angled slide edge 254 is pushed in a first direction (i.e., to the right in FIG. 3B, or toward the lower-left in FIG. 3H), thus pushing the sliding latch 256 in the same direction against the bias of the resilient extensions 267*a*, 267*b* until the sliding latch 256 is released from engagement with the latch holder 258, thereby allowing the upper part 282 of the body 200 to rise or ascend (i.e., move upwardly). Once the downward force is released from the opening button 250, the extensions 267*a*, 267*b* bias the sliding latch 256 and sliding lock 252 back to the initial position (FIGS. 3A, 3C and 3G). Thus, the angled slide edge 254 is preferably functionally adapted to translate and convert a vertical movement of the opening button 250 to a horizontal movement of the sliding lock 252. In accordance with the present invention, the upper chassis 282 preferably moves upwardly upon release of the sliding latch 256 from engagement with the latch holder 258, biased by the at least one and preferably two compression coil springs 260 that in the generally flat or folded configuration of the toy vehicle 20 are compressed and loaded. The compression coil springs 260 are preferably symmetrically located between and preferably directly contact the upper and lower parts 282, 280 of the body 200.

Upon release of the sliding latch 256 and the latch holder 258, the coil spring(s) 260 are released to push the upper chassis 282 upwardly. Preferably, the opening button 250 is a spring-like button designed to push the canopy 204 upwardly. When the upper chassis 282 ascends or rises, it creates a space that allows ascending or upward movement of the opening button 250 via the resiliently flexible beam 264 that is preferably adapted to push the opening button 250 upward which, in turn, pushes the canopy 204 upward. As the upper chassis 282 rises or moves upwardly, the upper chassis 282 activates the folding/unfolding system 220, and consequently each driving system 300*a*, 300*b* is rotated or "opened."

FIGS. 3A-3C show the folding/unfolding assembly 220, a battery compartment 270 that holds batteries 272*a*, 272*b*, a battery compartment cover 274, the driving system 300*b*, the track 304*b*, the canopy tail 205, the canopy axis 207 and the pushback bar 266. During folding of the toy vehicle 20, the pushback bar 266 is functionally adapted to push the canopy tail 205 upwardly and, thus, push the canopy 204 downwardly around the canopy axis 207. This movement, in turn, pushes the opening button 250 downwardly to thereby press the resiliently flexible beam 264 downwardly. FIG. 3B is an isometric view of toy vehicle 20 in the generally flat or folded configuration illustrating the toy vehicle 20 at the exact moment that the opening button 250 is being pressed downwardly. When the opening button 250 is pressed downwardly, the vertical movement of the press is translated to horizontal movement of the sliding lock 252, thereby allowing the opening of the toy vehicle 20 from the flat configuration to the three-dimensional erect configuration.

In another embodiment, a motor or other actuator (none shown), which is located as an alternative to the coil spring(s) 260, is preferably functionally adapted to move the upper body 282 upwardly upon an unfold command, which is received from a control system 276 (FIG. 4D), consequently transforming the toy vehicle 20 into the three-dimensional erect configuration. The same motor or actuator is then preferably used for folding the toy vehicle 20 back into the generally flat configuration upon a folding command received from the control system 276, which can be initiated by the pressing of a folding button (not shown) on the toy vehicle 20, or on a remote control unit 30. Alternatively, a single compression spring might be provided along the longitudinal center line in place of the battery 272*a*, 272*b*, which is moved or removed.

For purposes of clarity, the description of the driving systems 300*a*, 300*b* hereunder will refer to one system only. Referring now to FIGS. 4A and 4B, driving system 300*a* preferably includes the preferably electrical motor 310 that is coupled to a worm 312 that is preferably functionally adapted to convert rotational motion of the electrical motor 310 in the motor's axis to a rotational motion in a perpendicular axis relative to the motor axis. The worm 312 is preferably engaged with a gear train 314 that is functionally adapted to reduce circular velocity of electrical motor to a final translational velocity of the toy vehicle 20, while increasing the force that is provided to the tracks 304*a*, 304*b*. The gear train 314 preferably includes a first gear or worm gear 314*a* that is engaged on one side to the worm 312 and to a second gear 314*b* on the other opposite side. Thus, the first gear 314*a* rotates the second gear 314*b* while being rotated by the worm 312. The second gear 314*b* is preferably fixedly coupled to a coaxial third gear 314*c*, and consequently, the third gear 314*c* is preferably rotated upon rotation of the second gear 314*b*. The third gear 314*c* is also preferably engaged with a fourth gear 314*d*. Thus, rotation of the third gear 314*c* preferably rotates the fourth gear 314*d*. The fourth gear 314*d* is preferably engaged with and, therefore, rotates a fifth gear 316.

The fifth gear 316 preferably includes a built-in clutching system and rotates a bumps wheel 318, which further functions as a safety mechanism to avoid destruction of the gears of the gear train 314 upon an external force applied to the gear train 314. The bumps wheel 318 is preferably attached to the fifth gear 316 by at least one and preferably a pair of opposing, resiliently flexible or "springy" coupling arms 324*a*, 324*b* that preferably functionally couple the fifth or outer gear 316 and the bumpy or inner gear 318. The coupling arms 324*a*, 324*b* further preferably function as part of a safety mechanism as a torque limiting clutch for preventing damage to the gears of the gear train 314 when an external force is applied onto the tracks 304*a*, 304*b*. The bumps wheel 318 is also preferably coupled to the driving wheel 320 and, thus, rotates the driving wheel 320 while being rotated by the fifth gear 316. The driving wheel 320 is preferably further connected to the track 304*a* and, therefore, rotates the track 304*a* while being rotated by the bumps wheel 318.

Preferably, a wheel cover 330*b* (FIGS. 4A and 4B) is provided on an outer side of the fifth and bump gears 316, 318, fixed with the bump gear 318 to frictionally engage an inner side of track 304*a* and capture a circumferential inner rib 305*a* of track 304*a* (FIGS. 4A and 4B) with the driving wheel 320. It will be appreciated that mechanically interference engagement (e.g. cogs and teeth) can be provided between the driving wheel 320 and the track 304*a* or between the driving wheel 320 and the track 304*a* by omitting bump gear 318 or providing an equivalent elsewhere, such as between the second and third gears 314*b*, 314*c*.

The driving system 300*a* may further includes a free wheel (not shown), which is hidden in the figures behind the wheel cover 330*a*. The free wheel is supported for free rotation and supports the end of the track 304*a* remote from driving wheel 320 for rotation. The driving system 300*a* also preferably includes a frame 340*a* that supports the motor 310 with the worm 312 and the gear train 314 with the driving wheel 320 and the free wheel. As shown in FIGS. 4A and 4B, pins 336 preferably are provided to attach the cover 330*a* of the driving system 300*a*. As shown in FIG. 4A, a driving system hinge 350 preferably enables folding of the driving system 300*a* into the generally flat configuration of the toy vehicle 20. The routing of the electric wires 352 to the motor 310 is also shown in FIG. 4A. The electric wires 352 are preferably flexible wires, routed in a "minimal bending" design in order to prevent damage to the wires 352 upon multiple folding unfolding operations of the toy vehicle 20.

Referring to FIG. 4C, the suspension assembly 370*a* is preferably functionally directed to connect the body 200 to the driving system 300*a*. As the structure of the toy vehicle 20 is preferably symmetric, the suspension assembly 370*b* functionally connects the driving system 300*b* and body 200 as shown in FIG. 4D. For simplicity of the description reference is made hereinafter to suspension assembly 370*a* only. However the same description applies mutatis mutandis to the suspension assembly 370*b*. The suspension assembly 370*a* is preferably further adapted for routing the electrical wires 352*a* which controls the motor 310*a*. The suspension assembly 370*a* preferably includes a body or beam 372*a* fixedly supported from the lower chassis 280, the driving system hinge 350*a*, and stub axles 354*a* for the driving system hinge 350*a*. The electrical wires 352*a* are preferably routed via a tunnel 356*a* in the knuckle of hinge 350*a* to assure optimal routing of the wires 352*a* with minimal bending. It is noted that the wires 352*a* in FIG. 4C have been routed in an opposite direction to their depiction in FIG. 4A to better illustrate the body 372*a*. Each of the axles 354*a* may be supported for rotation between adjoining pairs of the pins 336 or in journals (not depicted) separately provided on the frame 340*a*.

Referring to FIG. 4D, the battery compartment cover 274 is shown placed on a lower section of the body 200 in proximity to the electronic assembly 276 that preferably controls operation of the toy vehicle 20 and the power supply unit and is conventional. The electronic assembly 276 may further comprise a remote control receiver which may be implemented utilizing RF (Radio Frequency), IR (Infrared), sound (such as ultrasound or US) waves, or other remote technologies. Preferably, the power supply unit includes the batteries 272, which may or may not be rechargeable. Alternatively, rechargeable capacitors may be used. In such embodiments, the toy vehicle 20 may have an ability of external charging. As shown in FIG. 4D, the body 200 is preferably functionally connected to the driving systems 300*a*, 300*b* directly via the suspension assemblies 370*a*, 370*b*, respectively.

Referring now to FIGS. 5A-5C, the shell 30 may function as a remote control (i.e. transmitter) functionally operating by light waves such as infra red (IR), radio frequency transmission (RF), or sound waves, such as ultrasound (US), to control the toy vehicle 20. In such an embodiment, remote control navigation buttons 34 are preferably used to move the toy vehicle 20 to the right or to the left, and navigation buttons 32 are preferably used to move the toy vehicle 20 forward or backward. The remote control 30 may further include a channel select switch 36. The toy vehicle 20 is preferably pulled out of the shell 30 through a pulling slot 38 formed within a portion of the shell 30 that enables a user to directly grasp a portion of the toy vehicle 20 and pull it out of the shell 30. The pulling slot 38 may further enable use of a thicker batteries compartment of the toy vehicle 20 without further increasing the height of the shell 30. When the toy vehicle 20 is in the generally flat configuration, a slot or cavity 40 is preferably used for inserting the toy vehicle 20 into the shell 30 for storage.

Other alternative arrangements include omitting the tracks 304 and supporting and propelling the toy vehicle 20 directly on the driving wheels 320 used as road wheels. The free wheel behind wheel cover 330*a* in each driving system 300*a*, 300*b* could remain freely rotating or alternatively also be driven, for example, by an endless flexible belt-like track 304 between a pulley on the driving wheel 320 or either the fifth or bump gears 316, 318 and a pulley on the free wheel. Alternatively, the gear train 314 could be additionally extended in an opposite direction to the free wheel.

The folding/unfolding assembly or linkage 220 is not limited to use in or with a toy vehicle. Instead, the linkage 220 may be used in vehicles of a variety of different sizes, such as a those capable of supporting a human, like a go-cart or even a larger vehicle, to allow reconfiguration of the device between an erect or "unfolded" or "open" configuration and a substantially flat or "folded" configuration. A larger vehicle that includes the linkage 220 would allow the vehicle to be folded to fit on or within a sport utility vehicle (SUV) or the bed of a pick-up truck, for example. Even larger versions of the vehicle could include the linkage 220, such as those sized to fit within the trailer of eighteen wheel truck, for example, when folded into the more compact configuration.

Similar to the toy vehicle 20, the larger vehicle preferably transforms from the unfolded configuration to the folded configuration by compression of the upper part 282 and lower part 280 together to actuate the linkage 220 and compress the compression spring 260. However, it will be appreciated that if the elements of the vehicle, especially a toy vehicle, are robust enough, it will be possible to transform such vehicle from the erect or open or unfolded configuration to the substantially flat or folded configuration simply by forcing the upper body part down on the lower body part while the vehicle is on a support surface or by folding the first and/or second members into the flat/folded configuration and using the linkage to compress the upper part against the lower part.

It will further be appreciated that in larger vehicles, as well as toy vehicles, other provisions may be provided for transforming the vehicle. For example, a motor driven or hand cranked reel 278*a* and cable 278*b* (FIG. 3C) may be provided for bringing the upper and lower body parts together to flatten the vehicle and compress the spring(s). As another alternative, the compression coil spring(s) 260 might be replaced by one or more other types of bias members positioned so as to bias the upper part 282 of the body 200 upward from the lower part 280 of the body 200 and actuate the linkage 220. For example, the compression coil spring(s) 260 might be replaced by another type of linear compression bias member, like a leaf spring or even a block of compressible foam material.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A vehicle reconfigurable between an unfolded configuration and a folded configuration comprising:

a body having opposing right and left lateral sides, opposing front and rear ends, and opposing upper and lower parts extending between the lateral sides and the ends;

a first wheel and a second wheel each operatively mounted to the body to at least partially support the body for movement;

a first suspension assembly and a second suspension assembly pivotally connecting each of the first wheel and the second wheel to the body;

a linkage connecting the body to each of the first and second wheels, the linkage adapted to pivot each wheel with respect to the body; and a linear compression bias member mounted between the upper and lower parts of the body to bias the upper part of the body away from the lower part of the body, wherein the vehicle transforms from the unfolded configuration to the folded configuration by compression of the upper part and lower part together to actuate the linkage and compress the linear compression bias member.

2. The vehicle according to claim 1 wherein in the folded configuration, each wheel extends in a plane generally parallel to a central horizontal longitudinal plane defined by the body, and, in the unfolded configuration, each wheel extends in a plane generally perpendicular to the central horizontal longitudinal plane defined by the lower part of the body.

3. The vehicle according to claim 1 wherein the body further comprises a hinge pivotally connecting the upper part to the lower part.

4. The vehicle according to claim 1 wherein the body further comprises a push button, a sliding latch and a latch holder, wherein upon application of force on the push button in the folded configuration, the sliding latch is moved out of engagement with the latch holder, and wherein upon release of force on the push button in the folded configuration, the linear compression bias member pushes the upper part of the body away from the lower part of the body to form the unfolded configuration of the vehicle.

5. The vehicle according to claim 4 wherein the folded configuration of the vehicle is achieved by moving the upper part of the body toward the lower part of the body against the bias of the linear compression bias member until the latch holder engages the sliding latch.

6. The vehicle according to claim 1 wherein the linkage includes at least one upper link, at least one turn crank, at least one side link, and at least one driving crank, wherein upon application of force on the upper part in the unfolded configuration, the upper part pushes the upper link downwardly, which rotates the turn crank, which pulls the side link inwardly toward a geometric center of the vehicle, which rotates the driving crank to pivot at least one of the wheels.

7. The vehicle according to claim 1 wherein at least one of the first and second wheels is operatively engaged with at least one motor, at least one worm, and at least one gear train.

8. The vehicle according to claim 7 wherein the at least one of the first and second wheels is operatively engaged with a track operatively connected to and rotated by the gear train.

9. The vehicle according to claim 1 wherein in the folded configuration, the vehicle is sized and shaped to fit within a cavity of a shell, and wherein the shell is a remote control unit to operate the vehicle in the unfolded configuration.

10. The toy vehicle according to claim 1 wherein a reel and cable are operatively connected to the upper part and lower part of the body to effectuate transformation of the vehicle from the unfolded configuration to the folded configuration by moving the upper part and lower part together.

11. The toy vehicle according to claim 1 wherein the linear compression bias member is a compression coil spring.

12. A vehicle comprising:

a body having opposing right and left lateral sides, opposing front and rear ends, and opposing upper and lower parts extending between the lateral sides and the ends;

a driving wheel operatively mounted to the body to at least partially support the body and propel the body on or across a support surface, the driving wheel rotatably mounted to a frame that supports a motor, a worm, and a gear train; and a suspension assembly pivotally connecting the frame to the body, wherein operation of the motor rotates the worm, which in turn drives the gear train, which in turn rotates the driving wheel to propel the vehicle.

13. The vehicle according to claim 12 wherein the vehicle is reconfigurable between a folded configuration and an unfolded configuration, in the folded configuration the driving wheel extends in a plane generally parallel to a central horizontal longitudinal plane defined by the body, in the unfolded configuration the driving wheel extends in a plane generally perpendicular to a central horizontal longitudinal plane defined by the body.

14. The vehicle according to claim 12 further comprising a track surrounding an entire periphery of the frame, wherein the track is driven by the driving wheel.

15. The vehicle according to claim 12 wherein the gear train includes an outer gear coupled to an inner gear by at least a resiliently flexible coupling arm to form a slip clutch between the gear train and the driving wheel.

* * * * *